US010971060B2

(12) United States Patent
Peng et al.

(10) Patent No.: US 10,971,060 B2
(45) Date of Patent: Apr. 6, 2021

(54) METHOD OF ADJUSTING DISPLAY BRIGHTNESS, LIGHT-EMISSION CONTROL CIRCUIT AND DISPLAY DEVICE

(71) Applicant: BOE TECHNOLOGY GROUP CO., LTD., Beijing (CN)

(72) Inventors: Kuanjun Peng, Beijing (CN); Chengchung Yang, Beijing (CN); Zhiqiang Xu, Beijing (CN)

(73) Assignee: Boe Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/614,709

(22) PCT Filed: Apr. 16, 2019

(86) PCT No.: PCT/CN2019/082861
§ 371 (c)(1),
(2) Date: Nov. 18, 2019

(87) PCT Pub. No.: WO2019/201234
PCT Pub. Date: Oct. 24, 2019

(65) Prior Publication Data

US 2020/0074921 A1 Mar. 5, 2020

(30) Foreign Application Priority Data

Apr. 17, 2018 (CN) ..... 201810344077.9

(51) Int. Cl.
*G09G 3/3208* (2016.01)

(52) U.S. Cl.
CPC ... *G09G 3/3208* (2013.01); *G09G 2320/0247* (2013.01); *G09G 2320/064* (2013.01)

(58) Field of Classification Search
CPC ..... G09G 2320/064; G09G 2320/0646; G09G 2320/0233; G09G 2320/0626;
(Continued)

(56) References Cited

U.S. PATENT DOCUMENTS

2004/0008252 A1 1/2004 Osame
2006/0017394 A1* 1/2006 Tada ..... G09G 3/3233 315/169.3
(Continued)

FOREIGN PATENT DOCUMENTS

CN 1855204 A 11/2006
CN 103021348 A 7/2008
(Continued)

OTHER PUBLICATIONS

International Search Report of PCT/CN2019/082861, dated Jul. 18, 2019, with English translation, 15 pages.
(Continued)

*Primary Examiner* — Dong Hui Liang
(74) *Attorney, Agent, or Firm* — Muncy, Geissler, Olds & Lowe, P.C.

(57) ABSTRACT

A method of adjusting display brightness, a light-emission control circuit and a display device are provided. A method of adjusting display brightness is applied to an light-emission control circuit, where the light-emission control circuit is configured to generate an light-emission control signal configured to control a light-emission of a display device. The method includes: adjusting, in the case that a display brightness of the display device is not within a predetermined brightness range, a duty ratio of the light-emission control signal, to enable the display brightness of the display device to fall into the predetermined brightness range.

13 Claims, 3 Drawing Sheets

(58) Field of Classification Search
CPC ..... G09G 2320/043; G09G 2360/16; G09G 2360/146; G09G 2330/021; G09G 3/3233; G09G 3/3406; G09G 3/3413
See application file for complete search history.

(56) References Cited

U.S. PATENT DOCUMENTS

| | | | | |
|---|---|---|---|---|
| 2006/0244387 | A1 | 11/2006 | Park | |
| 2008/0186265 | A1* | 8/2008 | Lee | G09G 3/3208 345/82 |
| 2011/0128303 | A1* | 6/2011 | Yonemaru | H05B 45/46 345/690 |
| 2012/0256971 | A1* | 10/2012 | Shin | G09G 3/3233 345/690 |
| 2013/0127924 | A1* | 5/2013 | Lee | G09G 3/32 345/690 |
| 2014/0125714 | A1* | 5/2014 | Pyo | G09G 3/3233 345/691 |
| 2016/0173862 | A1 | 6/2016 | Huang | |
| 2020/0074921 | A1 | 3/2020 | Peng | |

FOREIGN PATENT DOCUMENTS

| | | | |
|---|---|---|---|
| CN | 101707040 | A | 5/2010 |
| CN | 1032021348 | A | 4/2013 |
| CN | 105741792 | A | 7/2016 |
| CN | 106409238 | A | 2/2017 |
| CN | 106900117 | A | 6/2017 |
| CN | 107342058 | A | 11/2017 |
| CN | 107424572 | A | 12/2017 |
| CN | 108346399 | A | 7/2018 |

OTHER PUBLICATIONS

Office Action of CN Application No. 201810344077.9, dated Aug. 19, 2019, with English translation, 11 pages.

* cited by examiner

METHOD OF ADJUSTING DISPLAY BRIGHTNESS, LIGHT-EMISSION CONTROL CIRCUIT AND DISPLAY DEVICE

CROSS-REFERENCE TO RELATED APPLICATION

This application is the U.S. national phase of PCT Application PCT/CN2019/082861 filed on Apr. 16, 2019, which claims a priority to Chinese Patent Application No. 201810344077.9 filed on Apr. 17, 2018, the disclosures of which are incorporated in their entirety by reference herein.

TECHNICAL FIELD

The present disclosure relates to the field of display technologies, and in particular to a method of adjusting display brightness, a light-emission control circuit and a display device.

BACKGROUND

The Organic Light-Emitting Diode (OLED) display device has many advantages such as self-luminous, ultra-thin, fast response, high contrast, wide viewing angle and the like, and is a display device which has been widely concerned at present.

When the OLED display device works, the driving circuit drives the light emitting element to emit light, thereby realizing the display function of the OLED display device. However, since the thin film transistor in the driving circuit is prone to be subjected to the electric leakage when the driving circuit works, the display brightness of the OLED display device may decrease during the display duration of one frame, so the human eye may observe flickering display images. Moreover, in order to reduce the power consumption of the OLED display device, the OLED display device generally works in a low-frequency display state. However, when the OLED display device performs a low-frequency display, the electric leakage of the thin film transistor in the driving circuit may be more serious, and the human eye is more sensitive to the flickering phenomenon during the low-frequency display. As a result, the flickering phenomenon sensed by the human eye is more serious when the OLED display device performs the low-frequency display.

SUMMARY

A method of adjusting display brightness applied to an light-emission control circuit is provided in the present disclosure, where the light-emission control circuit is configured to generate an light-emission control signal configured to control a light-emission of a display device, where the method includes:

adjusting, in the case that a display brightness of the display device is not within a predetermined brightness range, a duty ratio of the light-emission control signal, to enable the display brightness of the display device to fall into the predetermined brightness range.

Optionally, the light-emission control circuit is configured to generate the light-emission control signal in response to a frame start signal, and the adjusting the duty ratio of the light-emission control signal includes: adjusting the duty ratio of the light-emission control signal by adjusting a duty ratio of the frame start signal.

Optionally, the adjusting, in the case that the display brightness of the display device is not within the predetermined brightness range, the duty ratio of the light-emission control signal, includes:

determining N time periods during which the display brightness of the display device is not within the predetermined brightness range within a display duration of each frame, where N is an integer greater than or equal to 1;

adjusting the duty ratio of the light-emission control signal by adjusting the duty ratio of the frame start signal, in each of the N time periods within the display duration of each frame.

Optionally, the predetermined brightness range is between a predetermined minimum brightness and a predetermined maximum brightness, and the adjusting, in the case that the display brightness of the display device is not within the predetermined brightness range, the duty ratio of the light-emission control signal, includes:

increasing the duty ratio of the frame start signal to increase the duty ratio of the light-emission control signal, in the case that the display brightness of the display device is less than the predetermined minimum brightness;

decreasing the duty ratio of the frame start signal to decrease the duty ratio of the light-emission control signal, in the case that the display brightness of the display device is greater than the predetermined maximum brightness.

Optionally, the method further includes:

increasing the duty ratio of the light-emission control signal to increase the display brightness of the display device, in the case that an ambient brightness of the display device is greater than the predetermined maximum brightness;

decreasing the duty ratio of the light-emission control signal to decrease the display brightness of the display device, in the case that the ambient brightness of the display device is less than the predetermined minimum brightness.

Optionally, at least a part of the duty ratios of the light-emission control signal corresponding to the N time periods are the same.

Optionally, an effective level of the light-emission control signal is a low level.

A light-emission control circuit is further provided in the present disclosure, for performing the method of adjusting display brightness hereinabove, including:

an adjusting circuit, configured to adjust, in the case that a display brightness of the display device is not within a predetermined brightness range, a duty ratio of the light-emission control signal, to enable the display brightness of the display device to fall into the predetermined brightness range.

Optionally, the adjusting circuit is configured to, in the case that the display brightness of the display device is not within the predetermined brightness range, adjust the duty ratio of the light-emission control signal by adjusting a duty ratio of a frame start signal.

Optionally, the adjusting circuit includes:

a determining sub-circuit, configured to determine N time periods during which the display brightness of the display device is not within the predetermined brightness range within a display duration of each frame, where N is an integer greater than or equal to 1;

an adjusting sub-circuit, configured to adjust the duty ratio of the light-emission control signal by adjusting the duty ratio of the frame start signal, in each of the N time periods within the display duration of each frame.

Optionally, the predetermined brightness range is between a predetermined minimum brightness and a predetermined maximum brightness;

the adjusting circuit is further configured to: increase the duty ratio of the frame start signal to increase the duty ratio of the light-emission control signal, in the case that the display brightness of the display device is less than the predetermined minimum brightness; decrease the duty ratio of the frame start signal to decrease the duty ratio of the light-emission control signal, in the case that the display brightness of the display device is greater than the predetermined maximum brightness;

the adjusting circuit is further configured to: increase the duty ratio of the light-emission control signal to increase the display brightness of the display device, in the case that an ambient brightness of the display device is greater than the predetermined maximum brightness; decrease the duty ratio of the light-emission control signal to decrease the display brightness of the display device, in the case that the ambient brightness of the display device is less than the predetermined minimum brightness.

Optionally, the light-emission control circuit further includes a sensor configured to detect the ambient brightness.

Optionally, at least a part of the duty ratios of the light-emission control signal corresponding to the N time periods are the same.

Optionally, an effective level of the light-emission control signal is a low level.

A display device including the light-emission control circuit hereinabove is further provided in the present disclosure.

BRIEF DESCRIPTION OF THE DRAWINGS

The drawings described herein are to provide a further understanding of the disclosure, and are intended to be a part of the disclosure. The embodiments and the descriptions thereof are to illustrate the present disclosure, but do not mean to limit the present disclosure improperly. In the drawings.

DETAILED DESCRIPTION

In order to further describe the method of adjusting display brightness, the light-emission control circuit and the display device in the embodiments of the present disclosure, the present disclosure will be described hereinafter in details in conjunction with the drawings.

A method of adjusting display brightness applied to an light-emission control circuit is provided in the embodiment of the present disclosure, where the light-emission control circuit is configured to generate an light-emission control signal EM configured to control a light-emission of a display device, where the method includes: adjusting, in the case that a display brightness of the display device is not within a predetermined brightness range, a duty ratio of the light-emission control signal EM, to enable the display brightness of the display device to fall into the predetermined brightness range.

Specifically, the specific structure of the light-emission control circuit in the related art is various. Generally, in the related art, by turning on and turning off a plurality of transistors in the clock signal control circuit, the high level signal control circuit and a low level signal control circuit and the like, an input frame start signal ESTV is converted into an output light-emission control signal EM. In order to clearly describe the operation of the light-emission control circuit, a specific light-emission control circuit is given below, and the operation process thereof will be described.

Figure 1:
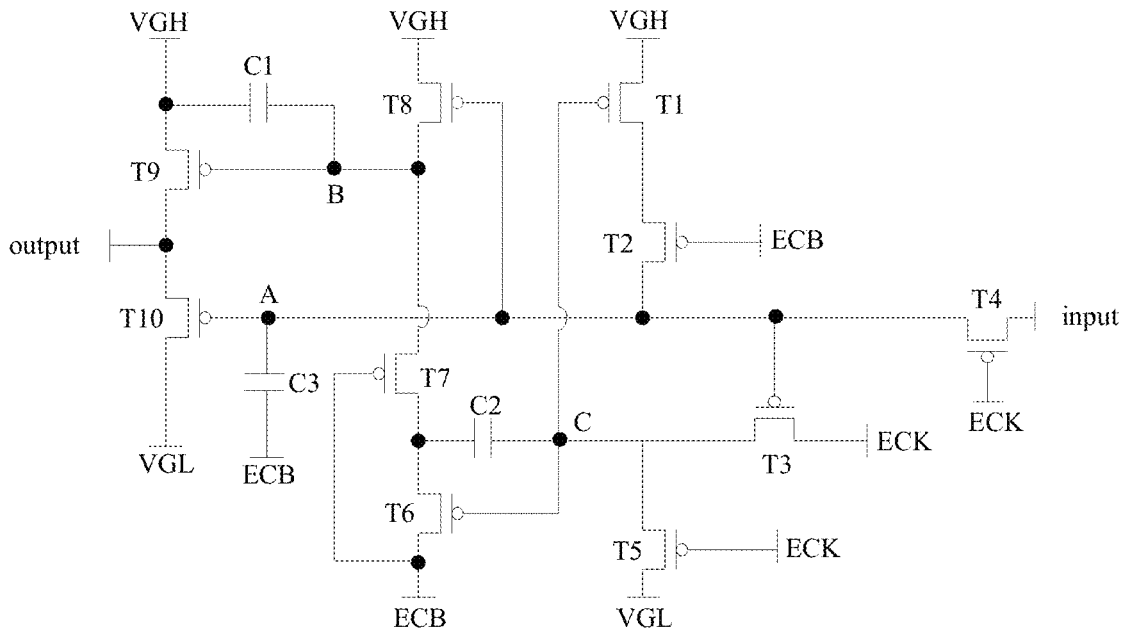
FIG. 1 is a schematic view of a light-emission control circuit in the related art.

As shown in FIG. 1, the light-emission control circuit includes: a first transistor T1, a second transistor T2, a third transistor T3, a fourth transistor T4, a fifth transistor T5, a sixth transistor T6, a seventh transistor T7, and an eighth transistor T8. a ninth transistor T9, a tenth transistor T10, a first capacitor C1, a second capacitor C2 and a third capacitor C3. The first transistor T1 to the tenth transistor T10 are all P-type transistors. The connection relationship of these transistors is as shown in the drawing. In the drawing, VGH represents a high level signal input terminal, VGL represents a low level signal input terminal, ECB and ECK represent clock signals, INPUT terminal is configured to input a frame start signal ESTV, and OUTPUT terminal is configured to output a light-emission control signal EM.

Figure 2:
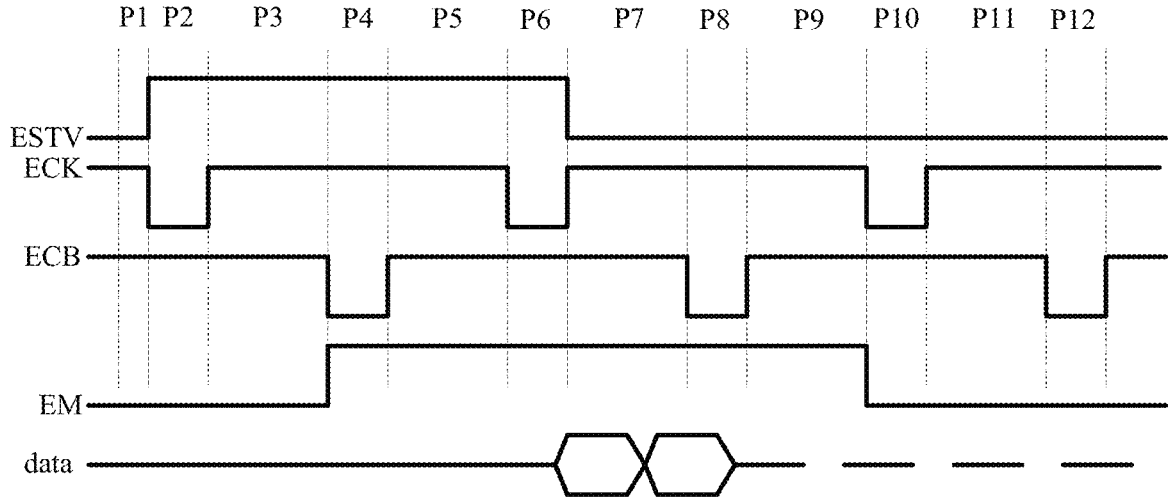
FIG. 2 is a timing diagram of a light-emission control circuit in the related art.

The actual operation process of the above light-emission control circuit is as follows: as shown in FIG. 2, in the first period P1, the second period P2 and the third period P3, the ECK signal terminal controls the fourth transistor T4 to be turned on, and a high level frame start signal ESTV is written to the node A in FIG. 1, so that under the control of the node A, the tenth transistor T10 is turned off. In the first period P1, the node B is at a high level, and the ninth switch transistor is turned off. The OUTPUT terminal outputs a light-emission control signal EM, and EM is at a low level at this time. From the fourth period P4 to the ninth period P9, the node C is at a low level, thereby controlling the sixth transistor T6 and the seventh transistor to be turned on, and the level of the node B is changed to a low level. The node B at the low level further controls the ninth transistor T9 to be turned on, and at the same time, since the node A continues to remain at the high level, the tenth transistor T10 is turned off, thereby enabling the OUTPUT terminal to output the high-level light-emission control signal EM. In the tenth time period P10, the INPUT terminal inputs a low-level frame start signal ESTV, and the ECK signal controls the fourth transistor T4 to be turned on, so that the low-level frame start signal ESTV is written to the node A, so that the level node A becomes a low level, so that the low-level node A controls the eighth transistor T8 and the tenth transistor T10 to be turned on. Further, the eighth transistor T8 is turned on, so that the level of the node B becomes a high level, thereby enabling the ninth The transistor T9 to be turned off and enabling the OUTPUT terminal to output a low-level light-emission control signal EM. In the twelfth period T12, the ECB signal is at a low level, and under the coupling of the third capacitor C3, the level of the point A becomes lower, so that the OUTPUT terminal continues to output the low-level light-emission control signal EM.

It should be noted that P5 in FIG. 2 represents the fifth time period, P6 represents the sixth time period, P7 represents the seventh time period, P8 represents the eighth time period, P11 represents the eleventh time period, and Data represents the data signal.

Further, since the light-emission control signal EM outputted by the light-emission control circuit is configured to control the display device to emit light, that is, the duty ratio of the light-emission control signal EM may determine the duty ratio of the bright state in the display brightness waveform LM of the display device. Therefore, when the brightness of the display device is not within the predetermined brightness range, the duty ratio of the bright state in the display brightness waveform LM of the display device may be adjusted by adjusting the duty ratio of the light-emission control signal EM, thereby controlling the light-emission brightness of the display device. It should be noted that the predetermined brightness range hereinabove may be set according to actual viewing needs.

According to the above analysis, according to the method of adjusting the display brightness in the embodiment of the present disclosure, when the light-emission brightness of the display device is not within the predetermined brightness range, the brightness of the display device may be adjusted to fall into the predetermined brightness range by adjusting the duty ratio of the light-emission control signal EM. As such, even if the display device is performing the low frequency display (for example, 30 Hz), when the display brightness of the display device decrease, the display brightness of the display device may be maintained within the predetermined brightness range according to the method in the present disclosure, thereby preventing the viewer from observing a flickering display image. Therefore, according to method of adjusting the display brightness in the embodiment of the present disclosure, the viewer may be prevented from observing a flickering display image when the display device is in the low frequency display state, thereby making the viewer to have a better user experience when the display device is low power consumption working state.

Further, the light-emission control circuit in the above embodiments is configured to generate the light-emission control signal EM in response to the frame start signal ESTV, and the adjusting the duty ratio of the light-emission control signal EM includes: adjusting the duty ratio of the light-emission control signal EM by adjusting a duty ratio of the frame start signal ESTV.

Specifically, in the light-emission control circuit in the above embodiments, the frame start signal ESTV is input to the INPUT terminal, and the light-emission control signal EM is outputted from the OUTPUT terminal, and the light-emission control circuit generates the light-emission control signal EM in response to the frame start signal ESTV. The duty ratio of the frame start signal ESTV determines the duty ratio of the light-emission control signal EM. When the display brightness of the display device is not within the predetermined brightness range, the duty ratio of the light-emission control signal EM may be adjusted by adjusting the duty ratio of the frame start signal ESTV, so as to further adjust the duty ratio of bright state in the display brightness waveform LM of the display device, thereby controlling the light-emission brightness of the display device.

Further, when the display brightness of the display device is not within the predetermined brightness range, the step of adjusting the duty ratio of the light-emission control signal EM includes:

determining N time periods during which the display brightness of the display device is not within the predetermined brightness range within a display duration of each frame, where N is an integer greater than or equal to 1;

adjusting the duty ratio of the light-emission control signal EM by adjusting the duty ratio of the frame start signal ESTV, in each of the N time periods within the display duration of each frame.

Specifically, when the display device is in an actual operation, due to electric leakage of the thin film transistor therein or other factors, the display brightness of the display device may decrease during a display duration of one frame. The decreasing time point of the display brightness of the display device may be distributed in different stages of the display duration of one frame. Therefore, in the method in the above embodiment, N time periods during which the display brightness of the display device is not within the predetermined brightness range within a display duration of each frame is determined firstly. Then, the duty ratio of the light-emission control signal EM is adjusted by adjusting the duty ratio of the frame start signal ESTV, in each of the N time periods during which the display brightness is not within the predetermined brightness range within the display duration of each frame, thereby adjusting the duty ratio of the bright state in the display brightness waveform LM of the display device, controlling the light-emission brightness of the display device to be within the predetermined brightness range, so that the viewer may not observe the flickering display image when viewing the image displayed by the display device in the low frequency display state.

It should be noted that, in the N time periods in which the display brightness is not within the predetermined brightness range, the duty ratio of the light-emission control signal EM corresponding to each time period may be set as needed, that is, the duty ratios of the light-emission control signal EM corresponding to the N time periods may be different, or may be the same or partially the same.

In addition, the way of determining N time periods during which the display brightness of the display device is not within the predetermined brightness range within a display duration of each frame is various. For example, the N time periods during which the display brightness of the display device is not within the predetermined brightness range may be determined during a pre-delivery inspection, but are not limited thereto.

The predetermined brightness range is between a predetermined minimum brightness and a predetermined maximum brightness, and the adjusting, in the case that the display brightness of the display device is not within the predetermined brightness range, the duty ratio of the light-emission control signal EM, includes:

increasing the duty ratio of the frame start signal ESTV to increase the duty ratio of the light-emission control signal EM, in the case that the display brightness of the display device is less than the predetermined minimum brightness;

decreasing the duty ratio of the frame start signal ESTV to decrease the duty ratio of the light-emission control signal EM, in the case that the display brightness of the display device is greater than the predetermined maximum brightness.

In more detail, there are two cases where the display brightness of the display device is not within the predetermined brightness range. In the first case, the display brightness of the display device is less than the predetermined minimum brightness; in the second case, the display brightness of the display device is greater than the predetermined maximum brightness. In the first case, that is, the display brightness of the display device is relative low, the duty ratio of the light-emission control signal EM may be increased by increasing the duty ratio of the frame start signal ESTV, thereby increasing the duty ratio of the bright state in the display brightness waveform LM of the display device and further increasing the display brightness of the display device. In the second case, that is, the display brightness of the display device is relative high, the duty ratio of the light-emission control signal EM may be decreased by decreasing the duty ratio of the frame start signal ESTV, thereby decreasing the duty ratio of the bright state in the display brightness waveform LM of the display device and further decreasing the display brightness of the display device.

For example, within the display duration of one frame of the display device, the display brightness is gradually decreased due to the gradual increase of the leakage current of the thin film transistor, and the specific process of adjusting the display brightness according to the method of adjusting display brightness in the above embodiments is described in detail.

Figure 3:
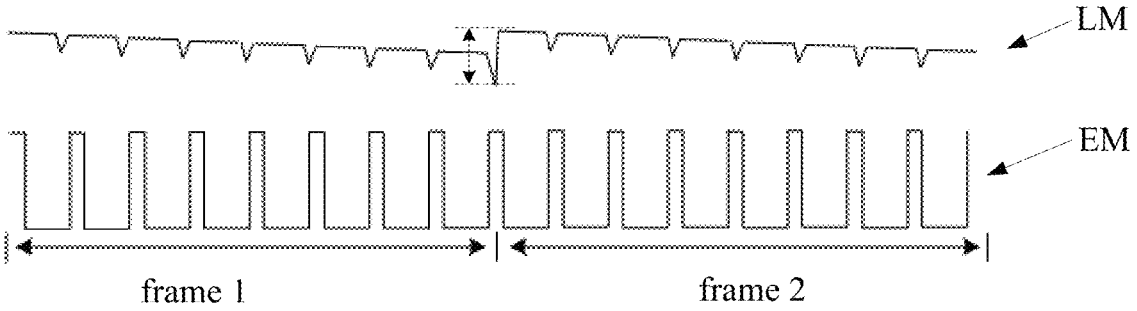
FIG. 3 is a schematic view showing a decrease in a display brightness waveform in one frame time in the related art.

As shown in FIG. 3, when the duty ratio of the frame start signal ESTV input to the light-emission control circuit is constant, the duty ratio of the light-emission control signal EM outputted by the light-emission control circuit is constant, and thus the duty ratio of the bright state in the display brightness waveform LM generated by the display device is constant. In addition, the waveform of the display brightness may keep declining due to the electric leakage of the thin film transistor in the driving circuit portion of the display device.

Figure 4:
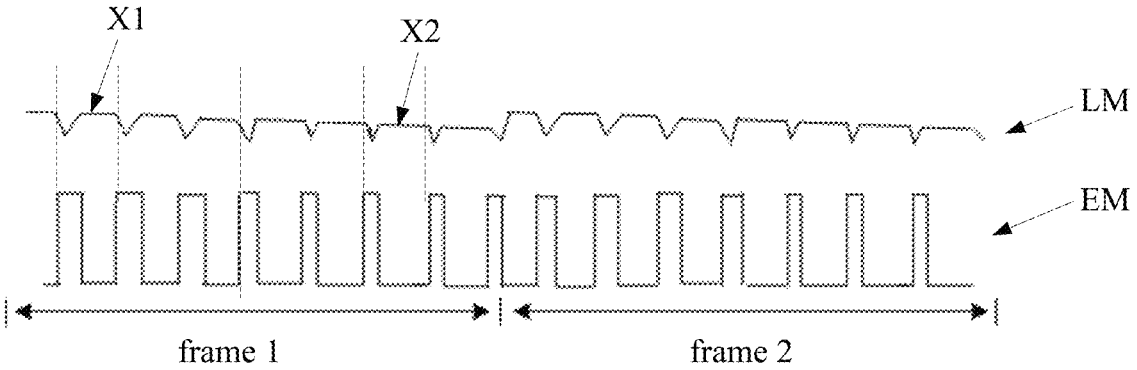
FIG. 4 is a schematic view of adjusting a duty ratio of a bright state in a display brightness waveform in one frame time in the embodiment of the present disclosure.

As shown in FIG. 4, the display duration of one frame (e.g., Frame1) is divided into two parts, that is, a display duration of the first half frame and a display duration of the last half frame, and it is determined that the display brightness of the display device is less than a predetermined minimum brightness in the display duration of the last half frame since the leakage current of the thin film transistor is increased. In this case, the duty ratio of the light-emission control signal EM may be increased by increasing the duty ratio of the frame start signal ESTV during the display time of the last half frame, thereby increasing the duty ratio of the bright state in the display brightness waveform LM of the display state (such as X2). Therefore, it may be ensured that the display brightness of the display device may be within the predetermined brightness range even if the maximum value of the display brightness is smaller than the maximum value of the display brightness corresponding to the first half frame. Therefore, the overall display brightness of the display device may remain unchanged. In the display time of the first half frame, since the leakage current of the thin film transistor is relative small, it may be ensured that the display brightness of the display device may be within a predetermined brightness range even if the duty ratio of the light-emission control signal EM is small, so there is no need to increase the duty ratio of the light-emission control signal EM, so that the duty ratio of the bright state in display brightness waveform LM (such as X1) of the display device may remain unchanged.

Figure 5:
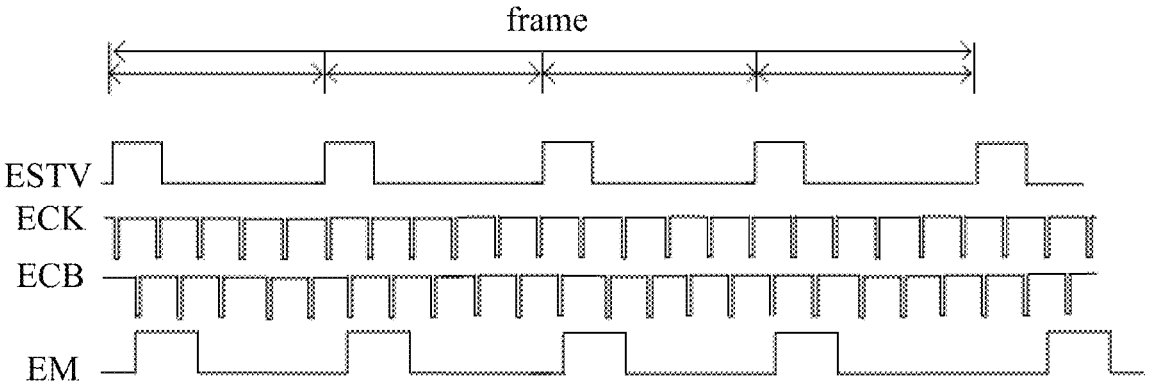
FIG. 5 is a schematic view showing a relationship between a duty ratio of a frame start signal and a duty ratio of a bright state in a display brightness waveform in one frame time in the related art.
Figure 6:
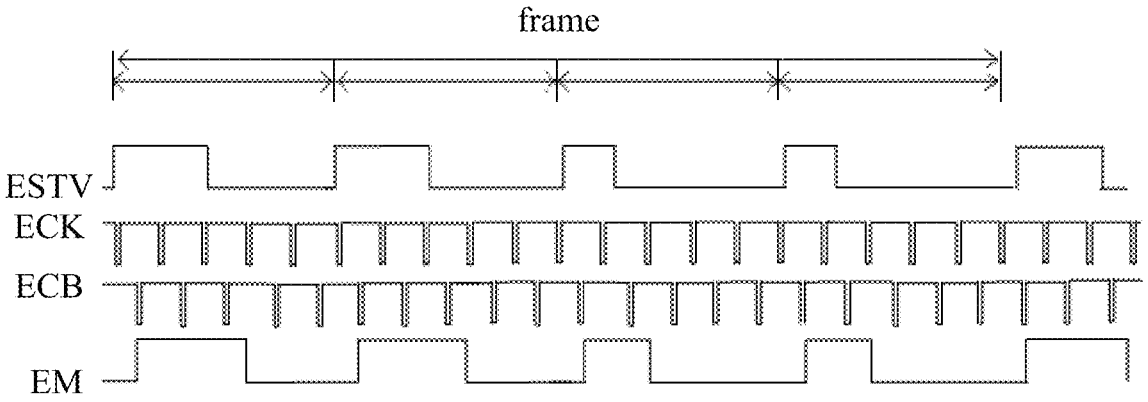
FIG. 6 is a schematic view showing a relationship between a duty ratio of a frame start signal and a duty ratio of a bright state in a display brightness waveform in one frame time in the embodiment of the present disclosure.

In order to more clearly explain the relationship between the frame start signal ESTV and the light-emission control signal EM, the display duration of one frame may be divided into four display periods equally, as shown in FIG. 5, in four display periods, the duty ratios of the frame start signal ESTV is constant, so that the duty ratio of the light-emission control signal EM may remain unchanged. As shown in FIG. 6, in the first two display periods, the frame start signal ESTV has a relative small duty ratio, and the corresponding light-emission control signal EM has a relative small duty ratio; in the last two display periods, the frame start signal ESTV has a relative large duty ratio, and the corresponding light-emission control signal EM has a relative large duty ratio.

It should be noted that the light-emission control signals EM shown in FIG. 3 to FIG. 6 are all at a low level, that is, the duty ratio of the light-emission control signal EM is a ratio of the low level in one period. Of course, the light-emission control signal EM may also be set to be effective at high level as needed.

Further, the method of adjusting display brightness in the above embodiment further includes:

increasing the duty ratio of the light-emission control signal to increase the display brightness of the display device, in the case that an ambient brightness of the display device is greater than the predetermined maximum brightness;

decreasing the duty ratio of the light-emission control signal to decrease the display brightness of the display device, in the case that the ambient brightness of the display device is less than the predetermined minimum brightness.

Specifically, the ambient light brightness may be detected by a sensor arranged on the display device, and the processor in the display device determines whether the ambient light brightness is greater than a predetermined maximum brightness or less than a predetermined minimum brightness. When the ambient light brightness of the environment where the display device is located is greater than the predetermined maximum brightness, the duty ratio of the light-emitting control signal EM may be increased by increasing the duty ratio of the frame start signal ESTV, thereby increasing the display brightness of the display device. When the ambient light brightness of the environment where the display device is located is less than the predetermined minimum brightness, the duty ratio of the light-emitting control signal EM may be decreased by decreasing the duty ratio of the frame start signal ESTV, thereby decreasing the display brightness of the display device.

A light-emission control circuit which is used to perform the method of adjusting display brightness in the above embodiments is provided in the embodiment of the present disclosure, including:

an adjusting circuit, configured to adjust, in the case that a display brightness of the display device is not within a predetermined brightness range, a duty ratio of the light-emission control signal, to enable the display brightness of the display device to fall into the predetermined brightness range.

Specifically, the method of adjusting display brightness in the above embodiments is applied to the light-emission control circuit, the light-emission control signal EM outputted by the light-emission control circuit is configured to control the display device to emit light, that is, the duty ratio of the light-emission control signal EM may determine the duty ratio of the bright state in the display brightness waveform LM of the display device. Therefore, when the brightness of the display device is not within the predetermined brightness range, the duty ratio of the bright state in the display brightness waveform LM of the display device may be adjusted by adjusting the duty ratio of the light-emission control signal EM by the light-emission control circuit in the embodiment of the present disclosure, thereby controlling the light-emission brightness of the display device.

According to the above analysis, according to the light-emission control circuit in the embodiment of the present disclosure, the adjusting circuit is able to adjust the duty ratio of the light-emission control signal EM so as to adjust the brightness of the display device to fall into the predetermined brightness range in the case that the light-emission brightness of the display device is not within the predetermined brightness range. As such, even if the display device is performing the low frequency display, when the display brightness of the display device decrease, the display brightness of the display device may be maintained within the predetermined brightness range by the light-emission control circuit in the embodiment of the present disclosure, thereby preventing the viewer from observing a flickering display image. Therefore, according to the light-emission control circuit in the embodiment of the present disclosure, the viewer may be prevented from observing a flickering display image when the display device is in the low frequency display state, thereby making the viewer to have a better user experience when the display device is low power consumption working state.

Further, the adjusting circuit in the above embodiment is configured to, in the case that the display brightness of the display device is not within the predetermined brightness range, adjust the duty ratio of the light-emission control signal EM by adjusting a duty ratio of a frame start signal ESTV.

Specifically, in the light-emission control circuit in the related art, the frame start signal ESTV is input to the INPUT terminal, and the light-emission control signal EM is outputted from the OUTPUT terminal, and the light-emission control circuit generates the light-emission control signal EM in response to the frame start signal ESTV. The duty ratio of the frame start signal ESTV determines the duty ratio of the light-emission control signal EM. When the display brightness of the display device is not within the predetermined brightness range, the duty ratio of the light-emission control signal EM may be adjusted by adjusting the duty ratio of the frame start signal ESTV, so as to further adjust the duty ratio of bright state in the display brightness waveform LM of the display device, thereby controlling the light-emission brightness of the display device.

Further, the adjusting circuit in the above embodiment includes:

a determining sub-circuit, configured to determine N time periods during which the display brightness of the display device is not within the predetermined brightness range within a display duration of each frame, where N is an integer greater than or equal to 1;

an adjusting sub-circuit, configured to adjust the duty ratio of the light-emission control signal by adjusting the duty ratio of the frame start signal, in each of the N time periods within the display duration of each frame.

Specifically, N time periods during which the display brightness of the display device is not within the predetermined brightness range within a display duration of each frame is determined firstly by the determining sub-circuit. Then, the duty ratio of the light-emission control signal EM is adjusted by adjusting the duty ratio of the frame start signal ESTV by the adjusting sub-circuit, in each of the N time periods during which the display brightness is not within the predetermined brightness range within the display duration of each frame, thereby adjusting the duty ratio of the bright state in the display brightness waveform LM of the display device, controlling the light-emission brightness of the display device to be within the predetermined brightness range, so that the viewer may not observe the flickering display image when viewing the image displayed by the display device in the low frequency display state.

Further, the predetermined brightness range is between a predetermined minimum brightness and a predetermined maximum brightness, and the adjusting circuit is further configured to: increase the duty ratio of the frame start signal ESTV to increase the duty ratio of the light-emission control signal EM, in the case that the display brightness of the display device is less than the predetermined minimum brightness; decrease the duty ratio of the frame start signal ESTV to decrease the duty ratio of the light-emission control signal EM, in the case that the display brightness of the display device is greater than the predetermined maximum brightness.

Further, the adjusting circuit is further configured to: increase the duty ratio of the light-emission control signal to increase the display brightness of the display device, in the case that an ambient brightness of the display device is greater than the predetermined maximum brightness; decrease the duty ratio of the light-emission control signal to decrease the display brightness of the display device, in the case that the ambient brightness of the display device is less than the predetermined minimum brightness.

Specifically, the ambient light brightness may be detected by a sensor arranged on the display device, and the processor in the display device determines whether the ambient light brightness is greater than a predetermined maximum brightness or less than a predetermined minimum brightness. When the ambient light brightness of the environment where the display device is located is greater than the predetermined maximum brightness, the duty ratio of the light-emitting control signal EM may be increased by increasing the duty ratio of the frame start signal ESTV, thereby increasing the display brightness of the display device. When the ambient light brightness of the environment where the display device is located is less than the predetermined minimum brightness, the duty ratio of the light-emitting control signal EM may be decreased by decreasing the duty ratio of the frame start signal ESTV, thereby decreasing the display brightness of the display device.

A display device is further provided in the embodiments of the present disclosure, which includes the light-emission control circuit in the above embodiments.

According to the light-emission control circuit in the embodiment of the present disclosure, the adjusting circuit is able to adjust the duty ratio of the light-emission control signal EM so as to adjust the brightness of the display device to fall into the predetermined brightness range in the case that the light-emission brightness of the display device is not within the predetermined brightness range. Therefore, when the display device includes the display brightness adjusting circuit in the above embodiments, it may be ensured that the brightness of image displayed by the display device may remain within the predetermined brightness range when the display device is in the low frequency display state, thereby preventing the viewer from observing a flickering display image. Therefore, according to the display device in the embodiment of the present disclosure, the viewer may be prevented from observing a flickering display image when the display device is in the low frequency display state, thereby making the viewer to have a better user experience when the display device is low power consumption working state.

In the description of the above embodiments, specific features, structures, materials or characteristics may be combined in any suitable manner in any one or more embodiments or examples.

The above are merely some embodiments of the present disclosure. A person skilled in the art may make further modifications and improvements without departing from the principle of the present disclosure, and these modifications and improvements shall also fall within the scope of the present disclosure. Therefore, the scope of the present disclosure may be subject to the scope of the claims.

What is claimed is:

1. A method of adjusting display brightness applied to a light-emission control circuit, wherein the light-emission control circuit is configured to generate a light-emission control signal configured to control a light-emission of a display device, wherein the method comprises:

adjusting, in the case that a display brightness of the display device is not within a predetermined brightness range, a duty ratio of the light-emission control signal, to enable the display brightness of the display device to fall into the predetermined brightness range, wherein the light-emission control circuit is configured to generate the light-emission control signal in response to a frame start signal, and the adjusting the duty ratio of the light-emission control signal comprises: adjusting the duty ratio of the light-emission control signal by adjusting a duty ratio of the frame start signal.

2. A light-emission control circuit for performing the method of adjusting display brightness according to claim 1, comprising:

an adjusting circuit, configured to adjust, in the case that a display brightness of the display device is not within a predetermined brightness range, a duty ratio of the light-emission control signal, to enable the display brightness of the display device to fall into the predetermined brightness range.

3. The light-emission control circuit according to claim 2, wherein the adjusting circuit comprises:

a determining sub-circuit, configured to determine N time periods during which the display brightness of the display device is not within the predetermined brightness range within a display duration of each frame, wherein N is an integer greater than or equal to 1;

an adjusting sub-circuit, configured to adjust the duty ratio of the light-emission control signal by adjusting the duty ratio of the frame start signal, in each of the N time periods within the display duration of each frame.

4. The light-emission control circuit according to claim 3, wherein at least a part of the duty ratios of the light-emission control signal corresponding to the N time periods are the same.

5. The light-emission control circuit according to claim 3, wherein an effective level of the light-emission control signal is a low level.

6. The light-emission control circuit according to claim 2, wherein the predetermined brightness range is between a predetermined minimum brightness and a predetermined maximum brightness, and the adjusting circuit is further configured to:

increase the duty ratio of the frame start signal to increase the duty ratio of the light-emission control signal, in the case that the display brightness of the display device is less than the predetermined minimum brightness;

decrease the duty ratio of the frame start signal to decrease the duty ratio of the light-emission control signal, in the case that the display brightness of the display device is greater than the predetermined maximum brightness;

the adjusting circuit is further configured to:

increase the duty ratio of the light-emission control signal to increase the display brightness of the display device, in the case that an ambient brightness of the display device is greater than the predetermined maximum brightness;

decrease the duty ratio of the light-emission control signal to decrease the display brightness of the display device, in the case that the ambient brightness of the display device is less than the predetermined minimum brightness.

7. The light-emission control circuit according to claim 6, further comprising a sensor configured to detect the ambient brightness.

8. A display device comprising the light-emission control circuit according to claim 2.

9. The method according to claim 1, wherein the adjusting, in the case that the display brightness of the display device is not within the predetermined brightness range, the duty ratio of the light-emission control signal, comprises:

determining N time periods during which the display brightness of the display device is not within the predetermined brightness range within a display duration of each frame, wherein N is an integer greater than or equal to 1;

adjusting the duty ratio of the light-emission control signal by adjusting the duty ratio of the frame start signal, in each of the N time periods within the display duration of each frame.

10. The method according to claim 9, wherein at least a part of the duty ratios of the light-emission control signal corresponding to the N time periods are the same.

11. The method according to claim 9, wherein an effective level of the light-emission control signal is a low level.

12. The method according to claim 1, wherein the predetermined brightness range is between a predetermined minimum brightness and a predetermined maximum brightness, and the adjusting, in the case that the display brightness of the display device is not within the predetermined brightness range, the duty ratio of the light-emission control signal, comprises:

increasing the duty ratio of the frame start signal to increase the duty ratio of the light-emission control signal, in the case that the display brightness of the display device is less than the predetermined minimum brightness;

decreasing the duty ratio of the frame start signal to decrease the duty ratio of the light-emission control signal, in the case that the display brightness of the display device is greater than the predetermined maximum brightness.

13. The method according to claim 12, further comprising:

increasing the duty ratio of the light-emission control signal to increase the display brightness of the display device, in the case that an ambient brightness of the display device is greater than the predetermined maximum brightness;

decreasing the duty ratio of the light-emission control signal to decrease the display brightness of the display device, in the case that the ambient brightness of the display device is less than the predetermined minimum brightness.

* * * * *